US009062674B2

(12) United States Patent
Ishihama et al.

(10) Patent No.: US 9,062,674 B2
(45) Date of Patent: Jun. 23, 2015

(54) VANE PUMP INCLUDING OUTER SIDE PLATE DEFINING HIGH AND LOW PRESSURE NOTCH GROOVES OF DIFFERING LENGTHS ADJACENT THE HIGH AND LOW DISCHARGE PORTS FOR IMPROVED NOISE PERFORMANCE

(75) Inventors: Hiroyuki Ishihama, Tochigi (JP); Naoya Taga, Tochigi (JP); Toshio Nishikawa, Tochigi (JP)

(73) Assignee: Showa Corporation, Saitama (JP)

( * ) Notice: Subject to any disclaimer, the term of this patent is extended or adjusted under 35 U.S.C. 154(b) by 142 days.

(21) Appl. No.: 13/424,318

(22) Filed: Mar. 19, 2012

(65) Prior Publication Data

US 2013/0052073 A1 Feb. 28, 2013

(30) Foreign Application Priority Data

Aug. 31, 2011 (JP) ..... 2011-188182

(51) Int. Cl.

| | |
|---|---|
| ***F04C 2/344*** | (2006.01) |
| ***F04C 15/00*** | (2006.01) |
| ***F04C 15/06*** | (2006.01) |
| ***F01C 21/10*** | (2006.01) |

(52) U.S. Cl.

CPC ..... *F04C 2/344* (2013.01); *F01C 21/108* (2013.01); *F04C 2/3446* (2013.01); *F04C 15/0049* (2013.01); *F04C 15/06* (2013.01)

(58) Field of Classification Search

USPC ..... 418/268, 26, 28, 15, 157, 189

See application file for complete search history.

(56) References Cited

U.S. PATENT DOCUMENTS

| | | | | |
|---|---|---|---|---|
| 5,518,380 | A * | 5/1996 | Fujii et al. | 418/26 |
| 6,068,461 | A * | 5/2000 | Haga et al. | 418/180 |
| 6,120,256 | A * | 9/2000 | Miyazawa | 417/220 |
| 6,203,303 | B1 * | 3/2001 | Fujiwara et al. | 418/269 |
| 2009/0047141 | A1 * | 2/2009 | Yamamuro et al. | 417/218 |

FOREIGN PATENT DOCUMENTS

| | | | |
|---|---|---|---|
| JP | 3573242 | B2 * | 10/2004 |
| KR | 2005011168 | A * | 1/2005 |
| WO | WO2005/005837 | | 1/2005 |

OTHER PUBLICATIONS

English Machine Translation of WO 2005005837 A1.*
English Machine Translation of JP 3573242 B2.*
English Abstract of KR 2005011168 A.*
English Abstract of KR 2005011168 A (Derwent Abstract and lone figure, printed Nov. 7, 2013).*

* cited by examiner

*Primary Examiner* — Mary A Davis
*Assistant Examiner* — Paul Thiede
(74) *Attorney, Agent, or Firm* — Keith Orum; Orum & Roth LLC

(57) ABSTRACT

In a vane pump, when discharge pressures of respective discharge ports are different from each other, an extension length L1 of a notch groove which is provided in the discharge port in a side of a high discharge pressure is set longer than an extension length L2 of a notch groove which is provided in the discharge port in a side of a low discharge pressure.

6 Claims, 8 Drawing Sheets

PRIOR ART

PRIOR ART

VANE PUMP INCLUDING OUTER SIDE PLATE DEFINING HIGH AND LOW PRESSURE NOTCH GROOVES OF DIFFERING LENGTHS ADJACENT THE HIGH AND LOW DISCHARGE PORTS FOR IMPROVED NOISE PERFORMANCE

BACKGROUND OF THE INVENTION

1. Field of the Invention

The present invention relates to a vane pump.

2. Description of the Related Art

As a vane pump, as described in WO2005/005837 (patent document 1), there is a structure having a rotor which is connected to a rotating shaft pivoted to an inner portion of a housing so as to rotate. A cam ring is arranged in such a manner as to surround the rotor in the inner portion of the housing. A plurality of vanes are slidably arranged in a plurality of vane grooves provided in a radial direction of the rotor. A plurality of pump chambers are defined by the adjacent vanes in the periphery of the rotor. A plurality of discharge ports corresponding to the pump chambers carrying out a compression stroke are provided to be opposed in a diametrical direction of the rotor. Notch grooves are extended in an inverse direction to a rotor rotation forward direction from hole edges in the inverse direction of the respective discharge ports. In this vane pump, a communication start point between each of the pump chambers and each of the discharge ports is quickened by the notch groove, and a communication time between the pump chamber and the discharge port becomes longer with respect to a rotating speed of the vane. Accordingly, since a moving time to the pump chamber of a working fluid pressure within the discharge port becomes longer, a hydraulic pressure change of the working fluid within the pump chamber becomes smaller. As a result, it is possible to reduce a serge pressure within the pump chamber and it is possible to lower an abnormal noise generation.

Further, as the vane pump, as described in Japanese Patent No. 3573242 (patent document 2), there is a structure in which a plurality of discharge ports are divided into a main discharge port which always carries out a discharge, and the other sub discharge port. For example, in the vane pump which is used in a power steering apparatus of a vehicle, it is desired to supply a sufficient flow rate to a fluid equipment of a steering in a low rotation area, and hold down an unnecessarily great flow rate for lowering uselessly consumed horse power in a high rotation area. Accordingly, in the low rotation area, a sufficient flow rate of pressure fluid is supplied to the fluid equipment from both of the main discharge port and the sub discharge port. Further, in the high rotation area, the pressure fluid is supplied to the fluid equipment only from the main discharge port, and the discharge oil of the sub discharge port is flowed back as surplus oil to a tank side (or an suction port corresponding to the same sub discharge port), thereby achieving a reduction of the consumed horse power.

FIGS. 7, 8A and 8B show the conventional vane pump mentioned above. Reference numeral 1 denotes a rotor. Reference symbol 1A denotes a vane groove. Reference symbol 1B denotes a vane. Reference symbol 1C denotes a pump chamber defined by the adjacent vanes 1B and 1B. Reference numeral 2 denotes a rotating shaft. Reference numeral 3 denotes a cam ring. Reference symbol 4M denotes a main discharge port. Reference symbol V1 denotes a notch groove. Reference symbol 4S denotes a sub discharge port. Reference symbol V2 denotes a notch groove, and reference numerals 5 and 6 denote a suction port. An extension length L1 of the notch groove V1 of the main discharge port 4M and an extension length L2 of the notch groove V2 of the sub discharge port 4S are set to the same length.

In the conventional vane pump mentioned above, in the case that the pressure fluid is supplied to the fluid equipment only from the main discharge port 4M, the working fluid pressure of the main discharge port 4M connected to a supply flow path to the fluid equipment becomes higher, and the working fluid pressure within the sub discharge port 4S connected to the tank side (or the suction port) becomes lower. As a result, as shown in FIG. 7, a relationship Fa>Fb is established between a pressure Fa which the working fluid pressure within the main discharge port 4M applies to the rotor 1 via the pump chamber 1C, and a pressure Fb which the working fluid pressure within the sub discharge port 4S applies to the rotor 1 via the pump chamber 1C, on a diameter of the rotor 1 which connects the main discharge port 4M and the sub discharge port 4S through the center of the rotor 1. The pressure difference Fa/Fb makes a center C of the rotor 1 displace from a center J of the cam ring 3 close to the sub discharge port 4S at a degree of a play of a serration by which the rotor 1 is connected to the rotating shaft 2 as shown in FIG. 8A to FIG. 8B. In accordance with this, the center C of the rotor 1 is offset from the center J of the cam ring 3, and in comparison with a timing at which the one vane 1B runs into the notch groove V1 of the main discharge port 4M, a timing at which the another vane 1B runs into the notch groove V2 of the sub discharge port 4S becomes faster, in two vanes 1B and 1B which are opposed to each other while holding the center C of the rotor 1 therebetween. Accordingly, the timings at which the respective pump chambers 1C defined by the vanes 1B are communicated respectively with the main discharge port 4M and the sub discharge port 4S are deviated from each other, and phases of pulsations of the hydraulic pressure within the respective discharge ports 4M and 4S are further deviated from each other, thereby causing an abnormal noise generation.

SUMMARY OF THE INVENTION

An object of the present invention is to synchronize phases of pulsations of a hydraulic pressure within respective discharge ports with each other so as to hold down an abnormal noise generation, at a time when discharge pressures of the respective discharge ports are different from each other, in a vane pump having a plurality of discharge ports which are provided with notch grooves for reducing a surge pressure within a pump chamber defined by adjacent vanes.

In one embodiment of the present invention, there is provided a vane pump comprising: a rotor which is connected to a rotating shaft pivoted to an inner portion of a housing so as to rotate; a cam ring which is arranged in such a manner as to surround the rotor in the inner portion of the housing. A plurality of vanes are slidably arranged in a plurality of vane grooves provided in a radial direction of the rotor; a plurality of pump chambers are defined by the adjacent vanes around the rotor. A plurality of discharge ports corresponding to the pump chambers carry out a compression stroke, which are provided to be opposed in a diametrical direction of the rotor. Notch grooves are provided each of which is extended from a hole edge in an inverse direction to a rotor rotating forward direction of each of the discharge ports to the inverse direction. When discharge pressure of the discharge ports are different from each other, an extension length of the notch groove which is provided in the discharge port in a side of a high discharge pressure is set longer than an extension length of the notch groove which is provided in the discharge port in a side of a low discharge pressure.

In another embodiment of the present invention, there is provided the vane pump, wherein two vanes which are positioned in both sides while holding a center of the rotor therebetween so as to be opposed are provided on a diameter of the rotor. When the center of the rotor displaces close to the discharge port in the side of the low discharge pressure at a degree of a play with the rotating shaft, a timing at which one vane runs into a leading end of the notch groove of the discharge port in the side of the high discharge pressure is set to the same as a timing at which another vane runs into a leading end of the notch groove of the discharge port in the side of the low discharge pressure.

In another embodiment of the present invention, there is provided the vane pump, wherein in the case that the plurality of discharge ports consist of a main discharge port which always carries out a supply of the discharge fluid, and the other sub discharge port, the main discharge port is the discharge port in the side of the high discharge pressure, and the sub discharge port is the discharge port in the side of the low discharge pressure.

In another embodiment of the present invention, there is provided the vane pump, wherein the notch groove is a V-shaped notch groove extended in such a manner as to be narrowed little by little from a hole edge in an inverse direction to a rotating forward direction of the rotor in the inverse direction, in the main discharge port and the sub discharge port.

In another embodiment of the present invention, there is provided the vane pump, wherein the extension length of the notch groove of the main discharge port and the extension length of the notch groove of the sub discharge port are set according to an amount of a play of a serration connection between the rotating shaft and the rotor, and a pressure difference of a discharge pressure between the main discharge port and the sub discharge port.

In another embodiment of the present invention, the vane pump is a fixed displacement type vane pump.

In accordance with the present embodiment, the following operations and effects can be achieved.

(a) When the discharge pressures of the respective discharge ports of the vane pump are different from each other, the extension length of the notch groove which is provided in the discharge port in the side of the high discharge pressure is set longer than the extension length of the notch groove which is provided in the discharge port in the side of the low discharge pressure. As a result, a relationship Fa>Fb is established between a pressure Fa which the working fluid pressure within the discharge port in the side of the high discharge pressure applies to the rotor via the pump chamber, and a pressure Fb which the working fluid pressure within the discharge port in the side of the low discharge pressure applies to the rotor via the pump chamber, on the diameter of the rotor which connects the discharge port in the side of the high discharge pressure and the discharge port in the side of the low discharge pressure through the center K of the rotor. The pressure difference Fa/Fb makes the center K of the rotor displace from the center L of the cam ring at a degree of the play of the serration by which the rotor is connected to the rotating shaft, as shown in FIG. 6A to FIG. 6B, and goes on maintaining the rotor at the offset position in FIG. 6B. Further, since the extension length A of the notch groove of the discharge port in the side of the high discharge pressure is longer than the extension length B of the notch groove of the discharge port in the side of the low discharge pressure (A>B), even if the center K of the rotor is offset from the center L of the cam ring as mentioned above, the timing at which the one vane runs into the leading end of the notch groove of the discharge port in the side of the high discharge pressure comes to the same as the timing at which the another vane runs into the leading end of the notch groove of the discharge port in the side of the low discharge pressure, in these two vanes which are opposed to each other while holding the center K of the rotor therebetween. Therefore, the timings at which the respective pump chambers zoned by the vanes are communicated respectively with the discharge port in the side of the high discharge pressure and the discharge port in the side of the low discharge pressure are the same, phases of the pulsations of the hydraulic pressure within the respective discharge ports are synchronized with each other, and it is possible to hold down an abnormal noise generation.

(b) In the vane pump in the item (a) mentioned above, when two vanes which are positioned in both sides while holding the center of the rotor therebetween and are opposed to each other are provided on the diameter of the rotor, and the center of the rotor displaces close to the discharge port in a side of the low discharge pressure at a degree of the play with the rotating shaft, the timing at which the one vane runs into the leading end of the notch groove of the discharge port in the side of the high discharge pressure is set at same time as the timing at which the another vane runs into the leading end of the notch groove of the discharge port in the side of the low discharge pressure.

(c) In the vane pump in the items (a) and (b) mentioned above, when the plurality of discharge ports consist of a main discharge port which always carries out a supply of the discharge oil, and the other sub discharge port, the main discharge port is constructed by the discharge port in the side of the high discharge pressure, and the sub discharge port is constructed by the discharge port in the side of the low discharge pressure, thereby achieving the items (a) and (b) mentioned above.

BRIEF DESCRIPTION OF THE DRAWINGS

The present invention will be more fully understood from the detailed description given below and from the accompanying drawings which should not be taken to be a limitation on the invention, but are for explanation and understanding only.

The drawings.

DESCRIPTION OF THE PREFERRED EMBODIMENTS

Figure 1:
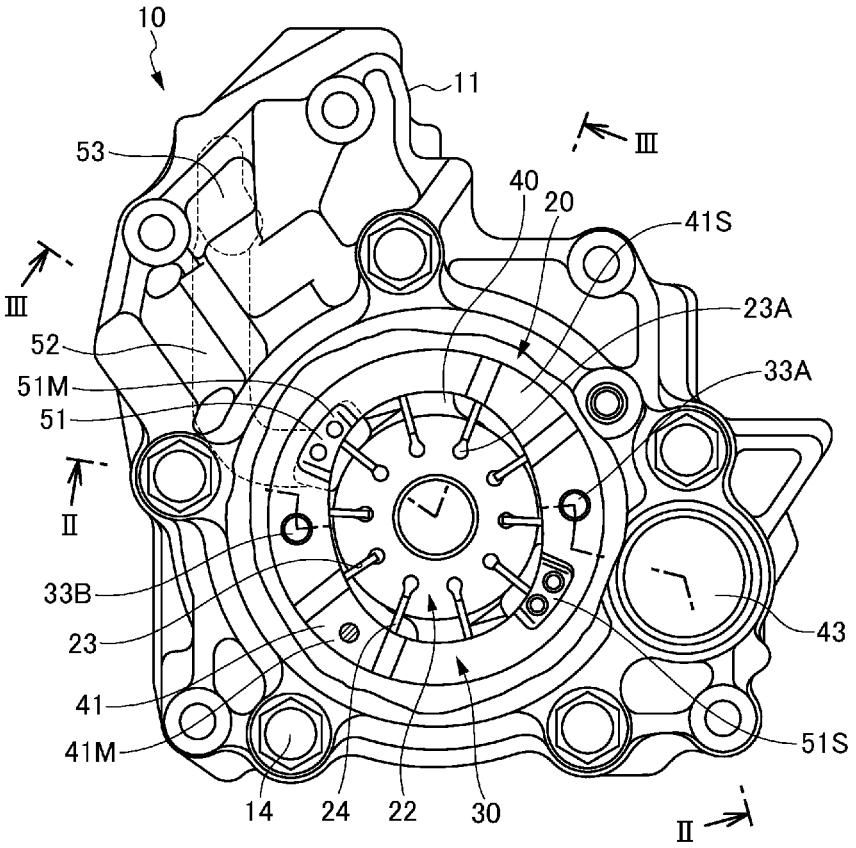
FIG. 1 is a side cross sectional view showing a vane pump.
Figure 2:
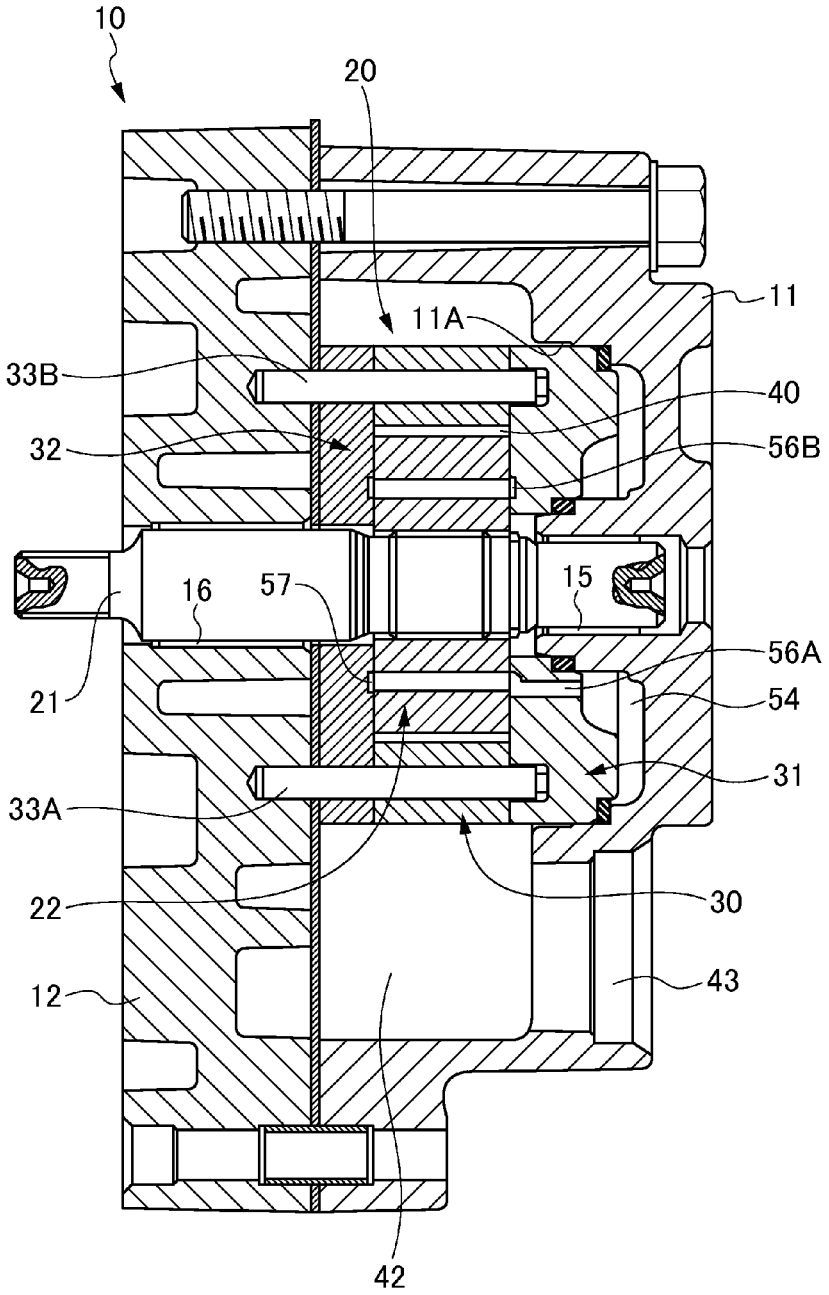
FIG. 2 is a cross sectional view along a line II-II in FIG. 1.
Figure 3:
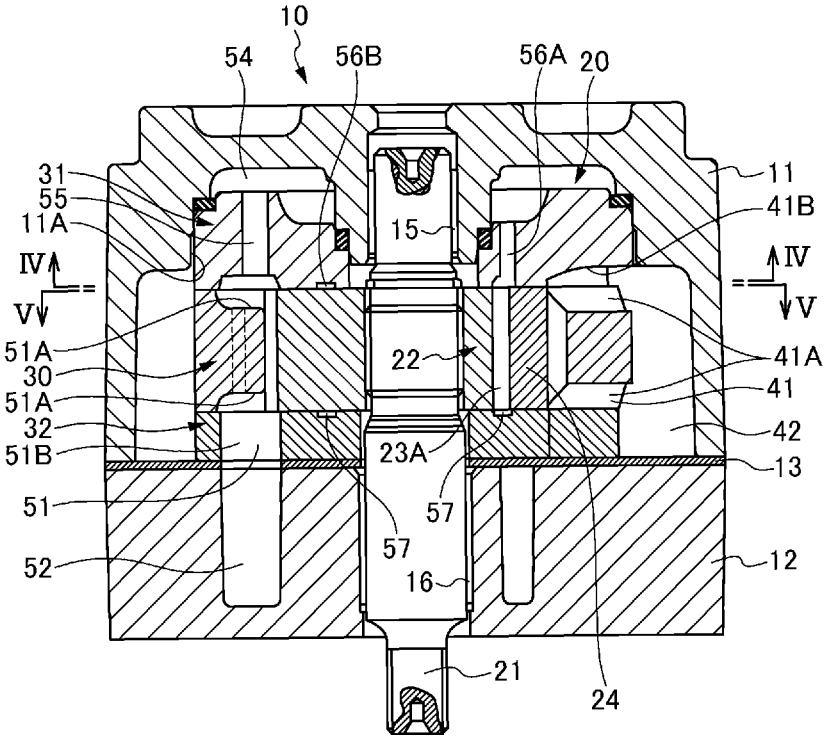
FIG. 3 is a cross sectional view along a line III-III in FIG. 1.

A vane pump 10 shown in FIG. 1 to FIG. 5 is a fixed displacement type vane pump. The vane pump 10 is driven, for example, by a power of an internal combustion engine, and is employed as an oil pump for supplying a working fluid serving as a fluid to a fluid pressure utilizing equipment, for example, a hydraulic power steering and a hydraulic continuously variable transmission.

The vane pump 10 has a housing 11 which is provided with a concave portion (an accommodating chamber) 11A accommodating a pump unit 20, a cover plate 12 which covers an opening portion of the concave portion 11A of the housing 11, and a seal plate 13 which is pinched between the housing 11 and the cover plate 12. The housing 11, the cover plate 12 and the seal plate 13 are fastened by a plurality of bolts 14 so as to be fixed. The seal plate 13 covers a plurality of passage grooves or lightening grooves which are formed in the housing 11 and the cover plate 12 so as to seal.

The vane pump 10 is structured such that a rotating shaft 21 of the pump unit 20 is pivoted to bearings 15 and 16 which are provided in the housing 11 and the cover plate 12, and a rotor 22 fixedly connected to the rotating shaft 21 via a serration is arranged in the concave portion 11A of the housing 11. The rotating shaft 21 and the rotor 22 are rotated by a power of the internal combustion engine.

Figure 5:
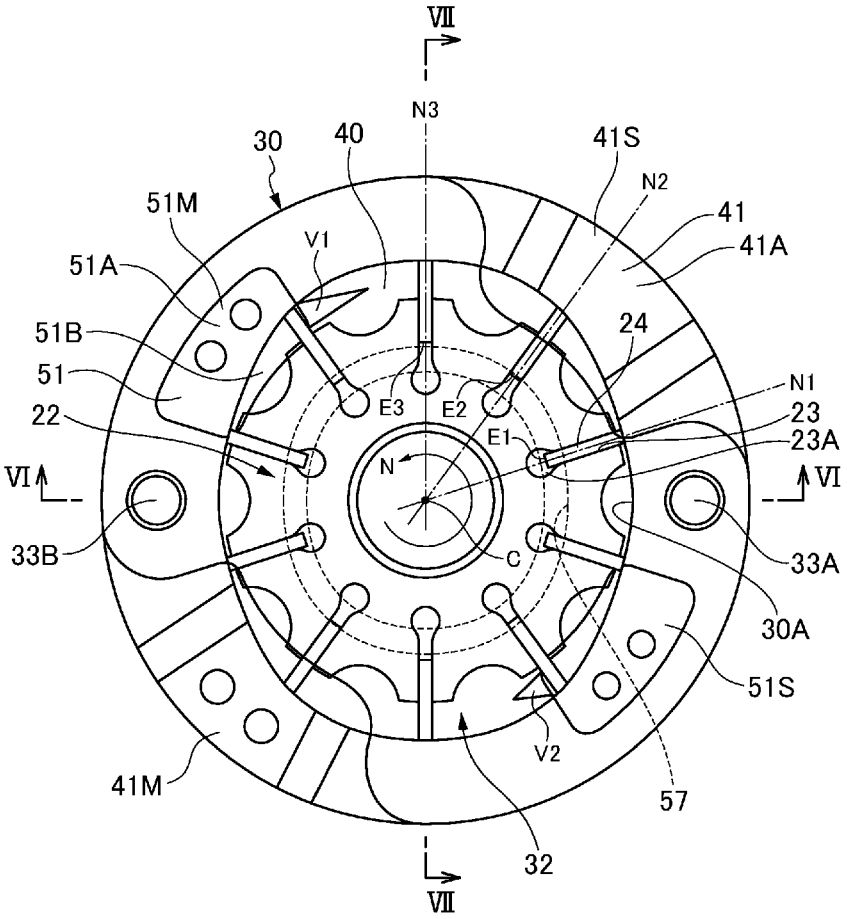
FIG. 5 is a view as seen from an arrow along a line V-V in FIG. 3.

The rotor 22 is structured, as shown in FIG. 5, such that a plurality of vanes 24 are accommodated in a plurality of vane grooves 23 which are provided in a radial direction (a diametrical direction) so as to freely rise and set, respectively at a plurality of positions along a peripheral direction, and each of the vanes 24 is arranged so as to be slidable in a radial direction along the vane groove 23. The rotor 22 is structured such that the vane groove 23 is open to an outer peripheral surface and both side surfaces.

The pump unit 20 is fitted and attached to the concave portion 11A of the housing 11, in such a manner that an inner side plate 31, a cam ring 30, and an outer side plate 32 are laminated in this order from a far side of the concave portion 11A. These inner side plate 31, the cam ring 30 and the outer side plate 32 are fixedly retained by the cover plate 12 from a lateral side in a state of being skewered by positioning pins 33A and 33B so as to be positioned in the peripheral direction, together with the seal plate 13 which is additionally provided in the outer side plate 32. In this case, the side plates 31 and 32 are formed as a perforated disc shape, and have center holes 31A and 32A into which the rotating shaft 21 of the rotor 22 is inserted.

The cam ring 30 is formed as a tubular shape which has a circular outer peripheral surface, and an inner peripheral surface forming a cam surface 30A by a cam curve which is similar to an oval, is fitted and attached to the concave portion 11A of the housing 11, and surrounds the rotor 22.

The inner side plate 31 and the outer side plate 32 construct a pair of plates which pinch the rotor 22, the vane 24 and the cam ring 30 from both sides. Accordingly, the cam ring 30 surrounds the rotor 22 and the vane 24 between both the side plates 31 and 32, and forms a pump chamber 40 between an outer peripheral surface of the rotor 22 and the adjacent vanes 24.

In the pump unit 20, in a suction area corresponding to the pump chamber 40 which carries out a suction stroke, in an upstream side of a rotation forward direction of the rotor 22, a suction port 41 (a suction port 41A and a suction port 41B) which are provided in the cam ring 30 and the inner side plate 31 are open, and a suction port 43 of the pump 10 is communicated with the suction port 41 via a suction passage 42 which is provided in the housing 11. The oil is sucked into a suction area in which the pump chamber 40 is expanded in conjunction with a rotation of the rotor 22.

In the present embodiment, the suction port 41 is provided at each of two positions which are opposed in a diametrical direction passing through the center C of the rotor 22 (a center J of the cam ring 30 and the inner side plate 31). One of these two suction ports 41 is set to a suction port 41M and another is set to a suction port 41S. These two suction ports 41M and 41S are arranged so as to be point symmetrical with respect to the centers K and L.

On the other hand, in a discharge area corresponding to the pump chamber 40 which carries out a compression stroke, in a downstream side of the rotation forward direction of the rotor 22, a discharge port 51 which is provided in the cam ring 30 and the outer side plate 32 is open, and a discharge port 53 of the pump 10 is communicated with the discharge port 51 (a discharge port 51A and a discharge port 51B) via a discharge passage 52 which is provided in the cover plate 12. The oil is discharged from the discharge area in which the pump chamber 40 is compressed in conjunction with the rotation of the rotor 22.

In this case, when the vane 24 rotating together with the rotor 22 is at a rotating angle position heading for the suction area from the discharge area mentioned above (which is also called as a maximum pressing rotational position of the vane 24), during one rotation of the rotor 22, the vane 24 is pressed into the vane groove 23 most deeply by the cam surface 30A of the cam ring 30. Further, when the vane 24 is at a rotating angle position heading for the discharge area from the suction area mentioned above (which is also called as a maximum pushing out rotational position of the vane 24), the vane 24 is pushed out most significantly to an outer side of the vane groove 23 by the cam surface 30A of the cam ring 30.

The pump unit 20 is provided with a high pressure chamber 54 which is defined by the inner side plate 31, in a farthest portion of the concave portion 11A of the housing 11. The inner side plate 31 has a high pressure oil supply port 55 which communicates the discharge port 51 provided in the cam ring 30 with the high pressure chamber 54, and the oil discharged from the discharge port 51 on the basis of the rotation of the rotor 22 is supplied to the high pressure chamber 54.

Figure 4:
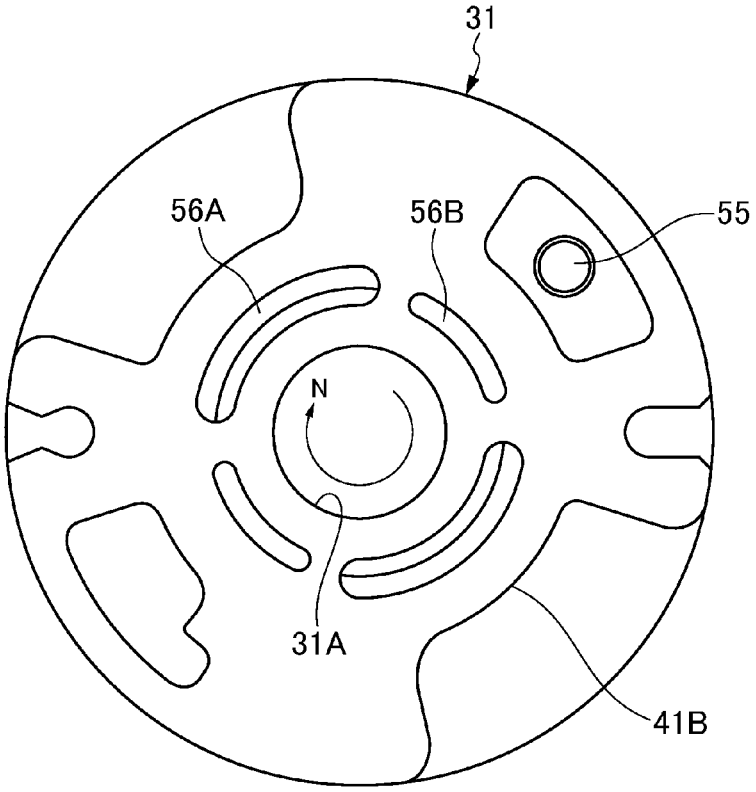
FIG. 4 is a view as seen from an arrow along a line IV-IV in FIG. 3.

The inner side plate 31 is structured, as shown in FIG. 4 and FIG. 5, such that a circular arc shaped high pressure oil introduction port 56A conducting the high pressure discharge oil in the high pressure chamber 54 to a space 23A close to a bottom portion of the vane groove 23 in a part of the peripheral direction of the rotor 22 is provided at two positions which are opposed to each other around the center hole 31A on the same diameter of the inner side plate 31. Further, the outer side plate 32 is provided in a surface which comes into contact with another side surface of the rotor 22, with an annular back pressure groove 57 which is communicated with the space 23A close to the bottom portion of the vane groove 23 in a whole portion of the rotor 22, and is communicated with the high pressure chamber 54 via the high pressure oil introduction port 56A mentioned above of the inner side plate 31. In this case, the inner side plate 31 is provided with a circular arc shaped communication groove 56B which is communicated with the space 23A close to the bottom portion of the vane groove 23 in a part of the peripheral direction of the rotor 22, at two positions which are pinched by the adjacent two high pressure oil introduction ports 56A and 56A on the surface coming into contact with the one side surface of the rotor 22.

In this case, the high pressure oil introduction port 56A of the inner side plate 31, the communication groove 56B and the back pressure groove 57 of the outer side plate 32 are set in such a manner as to be communicated with the space 23A close to the bottom portion of the vane groove 23 which is defined by base ends Ei (i=1, 2, 3, . . . ) of the vane 24 within the vane groove 23, whatever rotational position Ni (i=1, 2, 3, . . . ) the rotor 22 is provided at in a rotating forward direction N. In this case, in FIG. 5, reference symbol N1 corresponds to a maximum pressing rotational position of the vane 24, and reference symbol N3 corresponds to a maximum pushing out rotational position of the vane 24.

In accordance with this, the high pressure discharge oil which is discharged from the discharge port 51 so as to be supplied to the high pressure chamber 54 on the basis of the rotation of the rotor 22 is supplied to the annular back pressure groove 57 of the outer side plate 32 via the high pressure oil introduction port 56A of the inner side plate 31, and further via the space 23A close to the bottom portion of the vane groove 23 in a part of the rotor 22 with which the high pressure oil introduction port 56A is communicated. The high pressure discharge oil supplied to the annular back pressure groove 57 of the outer side plate 32 is simultaneously introduced to the space 23A close to the bottom portion of the vane groove 23 in a whole portion of the rotor 22 with which the back pressure groove 57 is communicated, and presses the leading end of the vane 24 against the cam surface 30A in the inner periphery of the cam ring 30 on the basis of the pressure of the high pressure discharge oil which is introduced to the space 23A close to the bottom portion of the vane groove 23 so as to bring it into contact. In this case, the high pressure discharge oil which is introduced to the space 23A close to the bottom portion of the vane groove 23 of the rotor 22 which is not communicated with the high pressure oil introduction port 56A of the inner side plate 31 is pressed into the communication groove 56B of the inner side plate 31 so as to be filled.

Accordingly, in the vane pump 10, if the rotating shaft 21 is rotated by the internal combustion engine, and the leading end of the vane 24 of the rotor 22 is rotated while being pressed against the cam surface 30A in the inner periphery of the cam ring 30, the oil from the suction port 41 is sucked into the pump chamber 40 which is expanded in conjunction with the rotation of the rotor 22, in the suction area in the upstream side of the rotation forward direction of the rotor 22. At the same time, in the discharge area in the downstream side of the rotation forward direction of the rotor 22, the oil from the pump chamber 40 which is compressed in conjunction with the rotation of the rotor 22 is discharged to the discharge port 51.

In the present embodiment, the discharge port 51 is provided in each of two positions which are opposed in the diametrical direction passing through the center C of the rotor 22 (the center J of the cam ring 30 and the outer side plate 32). One of these two discharge ports 51 is set to a main discharge port 51M, and another is set to a sub discharge port 51S. These two discharge ports 51M and 51S are arranged so as to be point symmetrical with respect to the centers K and L mentioned above.

The main discharge port 51M is connected to the discharge passage 52 and the discharge port 53 so as to always supply the discharge oil to the fluid equipment. The sub discharge port 51S is communicated with the discharge passage 52 and the discharge port 53 by a communication passage which is not illustrated, however, a flow path switch valve is provided in the communication passage, thereby switch communicating with a tank side passage which is branched from the flow path switch valve (or the suction port 41S corresponding to the sub discharge port 51S).

In the low rotation area of the internal combustion engine and the rotor 22, a sufficient flow rate of pressure oil is supplied to the fluid equipment from both of the main discharge port 51M and the sub discharge port 51S. Further, in the high rotation area, only the main discharge port 51M supplies the pressure oil to the fluid equipment, and the discharge oil of the sub discharge port 51S is flowed back as a surplus oil to the tank side (or the suction port 41S), thereby achieving a reduction of a consumed horse power.

Further, in the vane pump 10, there are provided V-shaped notch grooves V1 and V2 which are extended from a hole edge in an inverse direction to the rotation forward direction of the rotor 22 so as to be narrower little by little in the inverse direction, in the main discharge port 51M and the sub discharge port 51S. In accordance with this, in the pump unit 20, a communication start point between each of the pump chambers 40 and each of the discharge ports 51M and 51S is quickened on the basis of an existence of the notch grooves V1 and V2, and a communication time between the pump chamber 40 and the discharge ports 51M and 51S becomes longer with respect to the rotating speed of the vane 24. Therefore, as a moving time of the working fluid pressure within the discharge ports 51M and 51S to the pump chamber 40 becomes longer, a hydraulic pressure change of the working fluid within the pump chamber 40 becomes smaller. As a result, it is possible to reduce a surge pressure within the pump chamber 40 and it is possible to reduce abnormal noise generation.

Further, in the vane pump 10, the main discharge port 51M is connected to the discharge passage 52 and the discharge port 53 so as to always supply the discharge oil to the fluid equipment, and the main discharge port 51M is set to the discharge port 51 in a high discharge pressure side in which the discharge pressure is higher. On the other hand, the sub discharge port 51S comes to the discharge port 51 in a low discharge pressure side in which the discharge pressure is low, at a time of being connected to the tank side (or the suction port 41S) by the flow path switch valve. In the vane pump 10, taking into consideration a matter that the discharge pressures of the respective discharge ports 51M and 51S are different from each other, an extension length L1 of the notch groove V1 which is provided in the main discharge port 51M in the high discharge pressure side is set longer than an extension length L2 of the notch groove V2 which is provided in the sub discharge port 51S in the low discharge pressure side.

Figure 6A:
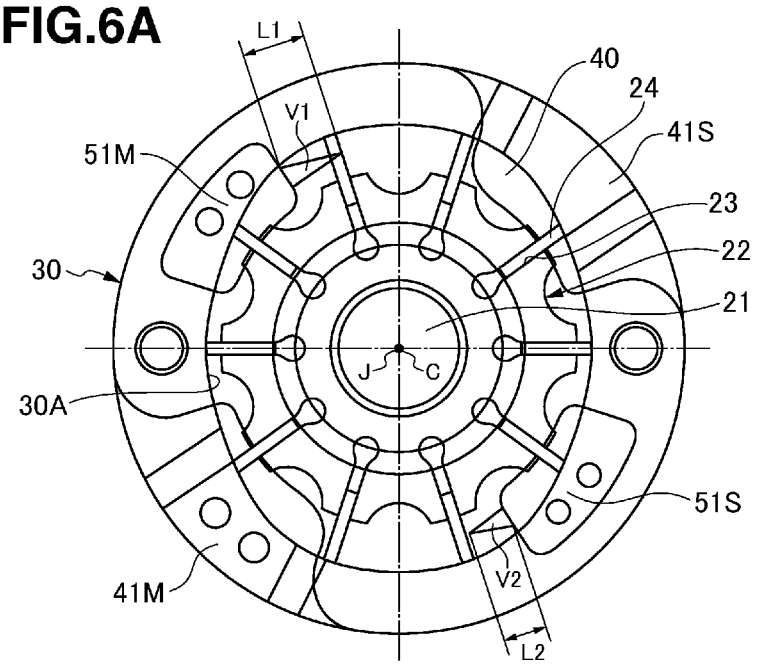
FIG. 6A and FIG. 6B are schematic views showing a state before and after a rotor displaces on the basis of a hydraulic pressure of a discharge port in a side of a high discharge pressure, in the embodiment in accordance with the present invention.
Figure 6B:
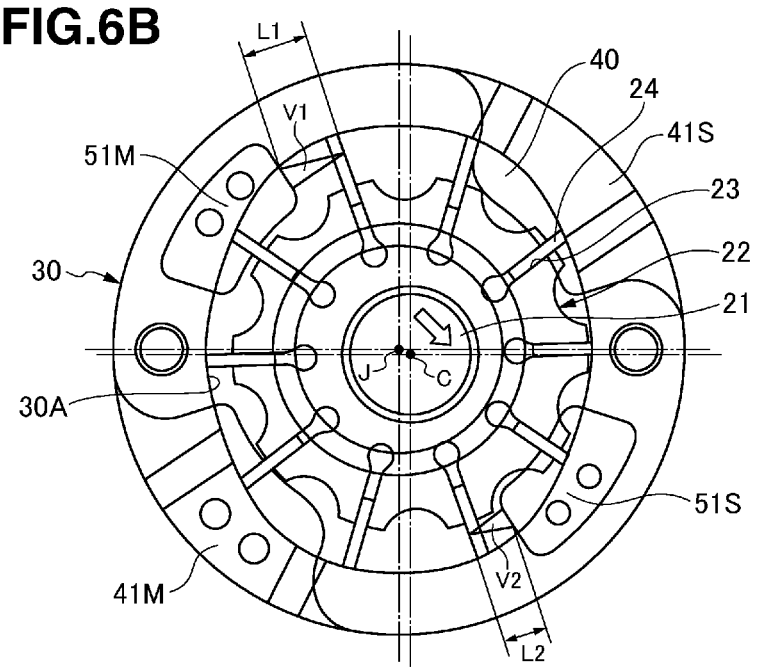
Figure 7:
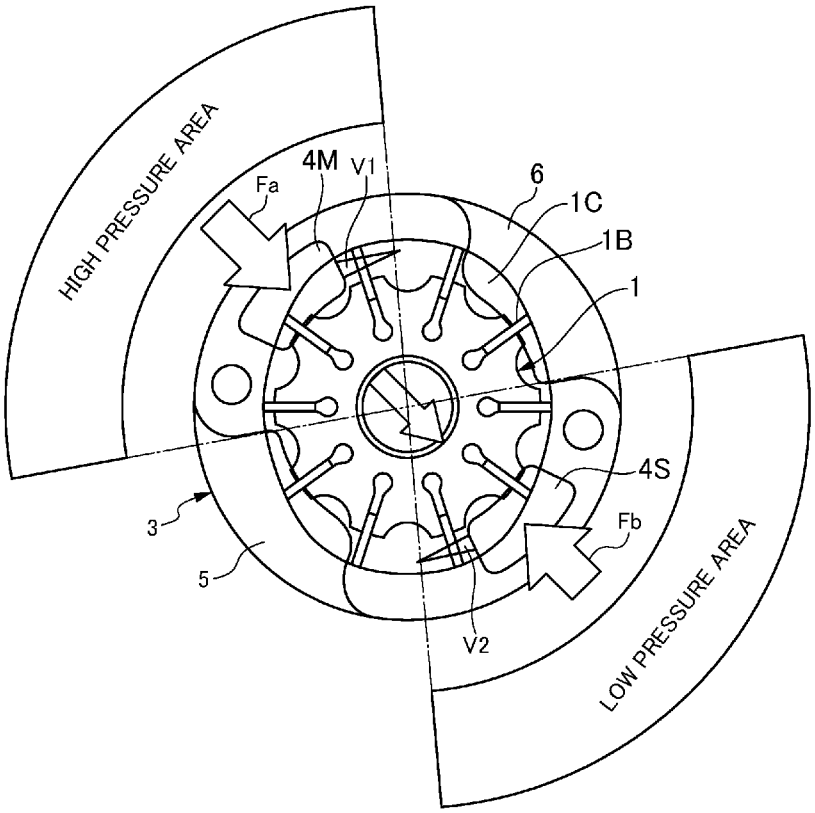
FIG. 7 is a prior art schematic view showing a principle by which the rotor displaces on the basis of the hydraulic pressure of the discharge port in the side of the high discharge pressure.
Figure 8A:
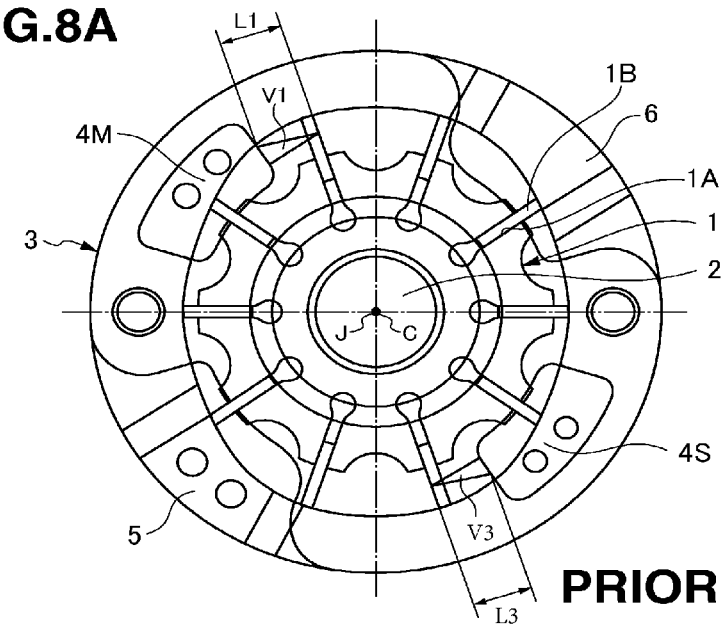
FIG. 8A and FIG. 8B are prior art schematic views showing a state before and after a rotor displaces on the basis of a hydraulic pressure of a discharge port in a side of a high discharge pressure, in a conventional example.
Figure 8B:
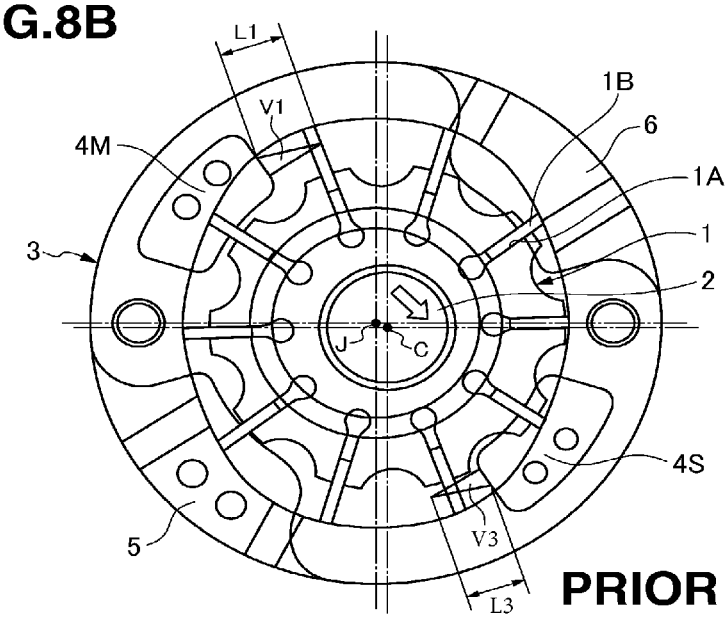
PRIOR ART FIG.8B

Further, in the vane pump 10, two vanes 24 and 24 which are positioned in both sides while holding the center C of the rotor 22 therebetween so as to be opposed are provided on the diameter of the rotor 22. When the center C of the rotor 22 displaces close to the sub discharge port 51S in a side of the low discharge pressure at a degree of a play of a serration connection with the rotating shaft 21 as shown in FIG. 6A to FIG. 6B, a timing at which the one vane 24 runs into the leading end of the notch groove V1 of the main discharge port 51M in the side of the high discharge pressure is set at same time as a timing at which the another vane 24 runs into the leading end of the notch groove V2 of the sub discharge port 51S in the side of the low discharge pressure.

The extension length L1 of the notch groove V1 of the main discharge port 51M and the extension length L2 of the notch groove V2 of the sub discharge port 51S are set according to an amount of the play of the serration connection between the rotating shaft 21 and the rotor 22, and a pressure difference of the discharge pressure between the main discharge port 51M and the sub discharge port 51S.

Accordingly, when the vane pump 10 discharges the pressure fluid to the fluid equipment only from the main discharge port 51M, the main discharge port 51M is set to the discharge port 51 in the side of the high discharge pressure, and the sub discharge port 51S is set to the discharge port 51 in the side of the low discharge pressure, the vane pump 10 is actuated as follows.

When the discharge pressures of the respective discharge ports 51M and 51S of the vane pump 10 are different from each other, the extension length L1 the notch groove V1 which is provided in the main discharge port 51M in the side of the high discharge pressure is set longer than the extension length L2 of the notch groove V2 which is provided in the sub discharge port 51S in the side of the low discharge pressure. As a result, a relationship Fa>Fb is established between a pressure Fa which the working fluid pressure within the main discharge port 51M in the side of the high discharge pressure applies to the rotor 22 via the pump chamber 40, and a pressure Fb which the working fluid pressure within the sub discharge port 51S in the side of the low discharge pressure applies to the rotor 22 via the pump chamber 40, on the diameter of the rotor 22 which connects the main discharge port 51M in the side of the high discharge pressure and the sub discharge port 51S in the side of the low discharge pressure through the center C of the rotor 22. The pressure difference Fa/Fb makes the center C of the rotor 22 displace from the center J of the cam ring 30 at a degree of the play of the serration by which the rotor 22 is connected to the rotating shaft 21, as shown in FIG. 6A to FIG. 6B, and goes on maintaining the rotor 22 at the offset position in FIG. 6B. Further, since the extension length L1 of the notch groove V1 of the main discharge port 51M in the side of the high discharge pressure is longer than the extension length L2 of the notch groove V2 of the sub discharge port 51S in the side of the low discharge pressure (A>B), even if the center C of the rotor 22 is offset from the center J of the cam ring 30 as mentioned above, the timing at which the one vane 24 runs into the leading end of the notch groove V1 of the main discharge port 51M in the side of the high discharge pressure comes to the same as the timing at which the another vane 24 runs into the leading end of the notch groove V2 of the sub discharge port 51S in the side of the low discharge pressure, in these two vanes 24 and 24 which are opposed to each other while holding the center C of the rotor 22 therebetween. Therefore, the timings at which the respective pump chambers 40 zoned by the vanes 24 and 24 are communicated respectively with the main discharge port 51M in the side of the high discharge pressure and the sub discharge port 51S in the side of the low discharge pressure are the same, phases of the pulsations of the hydraulic pressure within the respective discharge ports 51M and 51S are synchronized with each other, and it is possible to hold down an abnormal noise generation.

In this case, when the vane pump 10 discharges the pressure fluid to the fluid equipment from both of the main discharge port 51M and the sub discharge port 51S, both of the main discharge port 51M and the sub discharge port 51S come to the discharge port 51 in the side of the high discharge pressure having the same pressure, and the vane pump 10 is actuated as follows.

When the one vane 24 runs into the leading end of the longer notch groove V1 of the main discharge port 51M, and the another vane 24 does not run into the leading end of the shorter notch groove V2 of the sub discharge port 51S yet in these two vanes 24 and 24 which are positioned in both sides while holding the center C of the rotor 22 therebetween so as to be opposed to each other, the working fluid pressure within the main discharge port 51M is added to the rotor 22 via a whole area of the pump chamber 40 which is zoned by the one vane 24. On the basis of the pressure of the working fluid pressure within the main discharge port 51M, the center C of the rotor 22 displaces from the center J of the cam ring 30 as shown in FIG. 6A to FIG. 6B at the degree of the play of the serration by which the rotor 22 is connected to the rotating shaft 21, and positions the rotor 22 at an offset position in FIG. 6B. The another vane 24 immediately runs into the leading end of the shorter notch groove V2 of the sub discharge port 51S on the basis of the offset of the center C of the rotor 22, and the working fluid pressure within the sub discharge port 51S is added to the rotor 22 via a whole area of the pump chamber 40 which is defined by the another vane 24. Accordingly, the timings at which the respective pump chambers 40 zoned by the vanes 24 and 24 are communicated respectively with the main discharge port 51M and the sub discharge port 51S are the same as each other, the phases of the pulsation of the hydraulic pressure within the respective discharge ports 51M and 51S are synchronized with each other, and it is possible to hold down abnormal noise generation.

Even if each of the respective vanes 24 and 24 rotate within each of the discharge ports 51M and 51S after passing through the leading ends of the notch grooves V1 and V2 of each of the discharge ports 51M and 51S, the discharge pressures of both the discharge ports 51M and 51S which act on the rotor 22 via the pump chambers 40 zoned by the vanes 24 are the same pressure, and goes on maintaining the rotor 22 at the offset position in FIG. 6B, without pushing back the center C of the rotor 22 close to the center J of the cam ring 30 from the offset position in FIG. 6B.

In this case, the present invention is not limited to the vane pump in which a plurality of discharge ports consist of the main discharge port 51M in the side of the high discharge pressure and the sub discharge port 51S in the side of the low discharge pressure such as the embodiment mentioned above, but can be applied to a vane pump in which one comes to the discharge port in the side of the high discharge pressure and another comes to the discharge port in the side of the low discharge pressure on the basis of a difference of a flow path resistance of discharge paths of respective discharge ports.

As heretofore explained, embodiments of the present invention have been described in detail with reference to the drawings. However, the specific configurations of the present invention are not limited to the illustrated embodiments but those having a modification of the design within the range of the presently claimed invention are also included in the present invention.

In accordance with the present invention, there is provided a vane pump comprising: a rotor which is connected to a rotating shaft pivoted to an inner portion of a housing so as to rotate. A cam ring is arranged in such a manner as to surround the rotor in the inner portion of the housing. A plurality of vanes are slidably arranged in a plurality of vane grooves provided in a radial direction of the rotor. A plurality of pump chambers are defined by the adjacent vanes around the rotor. A plurality of discharge ports corresponding to the pump chambers carrying out a compression stroke, which are provided to be opposed in a diametrical direction of the rotor. Notch grooves are provided each of which is extended from a hole edge in an inverse direction to a rotor rotating forward direction of each of the discharge ports to the inverse direction. When discharge pressure of the discharge ports are different from each other, an extension length of the notch groove which is provided in the discharge port in a side of a high discharge pressure is set longer than an extension length of the notch groove which is provided in the discharge port in a side of a low discharge pressure. Accordingly, it is possible to synchronize phases of pulsations of a hydraulic pressure within respective discharge ports with each other so as to hold down an abnormal noise generation, at a time when discharge pressures of the respective discharge ports are different from each other, in a vane pump having a plurality of discharge ports which are provided with notch grooves for reducing a serge pressure within a pump chamber defined by adjacent vanes.

Although the invention has been illustrated and described with respect to several exemplary embodiments thereof, it should be understood by those skilled in the art that the foregoing and various other changes, omissions and additions may be made to the present invention without departing from the spirit and scope thereof. Therefore, the present invention should not be understood as limited to the specific embodiment set out above, but should be understood to include all possible embodiments which can be encompassed within a scope of equivalents thereof with respect to the features set out in the appended claims.

What is claimed is:

1. A vane pump comprising:

a rotor which is connected to a rotating shaft pivoted to an inner portion of a housing so as to rotate;

a cam ring which is arranged in such a manner as to surround the rotor in the inner portion of the housing, said cam ring being fixed with respect to the housing;

a plurality of movingly rotatable vanes which are slidably arranged in a plurality of vane grooves provided in a radial direction of the rotor;

a plurality of pump chambers which are defined by the adjacent vanes around the rotor;

a high pressure discharge port and a low pressure discharge port defined in said cam ring corresponding to the pump chambers carrying out a compression stroke, the high pressure discharge port being opposingly disposed from the low pressure discharge port along a diameter direction of the rotor; and a high pressure notch groove and a low pressure notch groove defined in an outer side plate of the vane pump, the high pressure notch groove extending in a direction away from an edge of the high pressure discharge port and the low pressure notch groove extending in a direction away from an edge of the low pressure discharge port, a length of the high pressure notch groove is greater than a length of the low pressure notch groove, and a first vane and a second vane of the plurality of movingly rotatable vanes are respectively positioned on opposite portions of the rotor so as to be opposed one-to-another along the diameter direction of the rotor, the rotor having two positions during operation of the vane pump, a first unshifted position and a second shifted position, the shifting occurring due to a force applied to the rotor resulting from differing pressures occurring respectively at the high pressure discharge port and the low pressure discharge port as the vane pump transitions from a static state to an operating state, and when the rotor is disposed in the second shifted position the center of the rotor is disposed closer to the low pressure discharge port on the side of the vane pump having the low discharge pressure, wherein when the rotor is disposed in said second shifted position said first vane of the plurality of movingly rotatable vanes encounters a leading end of the high pressure notch groove at the high pressure discharge port in a side of the vane pump having the high discharge pressure in a rotation direction of the rotor at the same moment at which said second vane of the plurality of movingly rotatable vanes encounters a leading end of the low pressure notch groove at the low pressure discharge port in a side of the vane pump having the low discharge pressure in the rotation direction of the rotor.

2. The vane pump according to claim 1, wherein the high pressure notch groove and the low pressure notch groove are V-shaped, respectively, and the open end of the V-shape of the high pressure notch groove is disposed adjacent the edge of the high pressure discharge port and the open end of the V-shape of the low pressure notch groove is disposed adjacent the edge of the low pressure discharge port.

3. The vane pump according to claim 2, wherein the different respective lengths of said V-shaped high pressure notch groove and said V-shaped low pressure notch groove correspond to an amount of a play between the rotating shaft and the rotor manifested from a pressure difference of a discharge pressure between the high pressure discharge port and the low pressure discharge port.

4. The vane pump according to claim 3, wherein the vane pump is a fixed displacement vane pump.

5. The vane pump according to claim 2, wherein the vane pump is a fixed displacement vane pump.

6. The vane pump according to claim 1, wherein the vane pump is a fixed displacement vane pump.

* * * * *